US006796152B1

(12) United States Patent
Yu

(10) Patent No.: US 6,796,152 B1
(45) Date of Patent: Sep. 28, 2004

(54) BURGLARPROOF LOCK FOR A COMPUTER

(76) Inventor: Chun Te Yu, No. 41-21, Kuan-Tsui St., Hsia-Nien, Tsun Fu-Hsing, Changhua County (TW)

( * ) Notice: Subject to any disclaimer, the term of this patent is extended or adjusted under 35 U.S.C. 154(b) by 0 days.

(21) Appl. No.: 10/660,650

(22) Filed: Sep. 12, 2003

(30) Foreign Application Priority Data

Jul. 21, 2003 (TW) ..... 92213323 U

(51) Int. Cl.[7] ..... E05B 73/00

(52) U.S. Cl. ..... 70/58; 70/14; 70/23; 70/57; 70/DIG. 57; 439/133

(58) Field of Search ..... 70/14, 23, 30, 70/38 A, 57, 58, 386, DIG. 57

(56) References Cited

U.S. PATENT DOCUMENTS 4,610,152 A * 9/1986 Duringer ..... 70/30
5,190,465 A * 3/1993 Davidge et al. ..... 439/133
5,220,815 A * 6/1993 Davidge et al. ..... 70/57
5,288,241 A * 2/1994 Davidge et al. ..... 439/133
5,934,120 A * 8/1999 Kuo ..... 70/30
6,058,744 A * 5/2000 Ling ..... 70/58
6,212,922 B1 * 4/2001 Miao ..... 70/58
6,401,502 B1 * 6/2002 Yang ..... 70/58
6,463,770 B1 * 10/2002 Lee ..... 70/58
6,522,532 B2 * 2/2003 Liao et al. ..... 439/133
6,523,373 B1 * 2/2003 Su ..... 70/58

* cited by examiner

*Primary Examiner*—Daniel P. Stodola
*Assistant Examiner*—Christopher Boswell
(74) *Attorney, Agent, or Firm*—Troxell Law Office PLLC

(57) ABSTRACT

A burglarproof lock for a computer which blocks the connecting port so that an unauthorized person cannot connect another connector with the connecting port to steal data. The burglarproof lock includes a housing having a connecting section and defining a cavity in which a lock apparatus is mounted. A clutch is disposed in the cavity for controlling unlocking/locking of the lock apparatus. The clutch includes a tool mounted on a lock core of the lock apparatus, a valve body controlled by the tool to be movable or unmovable and a complex bolt having an axially movable and rotatable adjustment press button and a bolt member rotatable along with the adjustment press button.

34 Claims, 6 Drawing Sheets

BURGLARPROOF LOCK FOR A COMPUTER

BACKGROUND OF THE INVENTION

The present invention is related to a burglarproof lock for preventing a portable computer from being stolen. The burglarproof lock can be locked on a connecting port of the computer so that an unauthorized person cannot connect other connector with the connecting port to thieve information.

Nowadays, portable computers are widely used in various fields such as personal data processing, information link and transmission, etc. Such portable computers are apt to be thieved by unauthorized persons. Therefore, many burglarproof locks for the portable computers have been developed for preventing the portable computers from being stolen. For example, Taiwanese Patent No. 87220494 discloses a numeral lock including a locking bolt which can be inserted in a hole or slot of an article. Taiwanese Patent No. 89202220 discloses a lock apparatus which can be directly pressed to lock an article. Taiwanese Patent No. 88220085 discloses a computer lock. Taiwanese Patent No. 87205390 discloses a lock for portable computer. Taiwanese Patent No. 89201937 discloses a burglarproof lock for a computer. Taiwanese Patent No. 88221916 discloses a numeral lock including a steel cord which can be passed through a connector of an article to lock the article. Taiwanese Patent No. 89220918 discloses a structure which can be directly latched and locked with an article. In the above Patents, a locking bolt or hook is reciprocally movably extended into a hole or slot of the portable computer to lock the computer so as to prevent the computer from being stolen.

All the above Patents are transfigured from ordinary steel cord lock. One end of the steel cord can be extended into a hole or slot of the housing of the portable computer. The other end of the steel cord is conducted to be fixed on another article such as a computer desk.

In fact, the portable computer can be otherwise locked. For example, the burglarproof lock can be locked with any other section instead of the hole or slot of the housing of the computer. In addition, it is possible that when a user temporarily leaves the portable computer, an unauthorized person may plug another connector into the connecting port of the computer to thieve confidential data. Therefore, in the case that the burglarproof lock can be locked with the connecting port of the portable computer, not only the computer is prevented from being stolen, but also an unauthorized person cannot plug another connector into the connecting port of the computer to thieve confidential data. This issue is not disclosed in any of the above Patents.

SUMMARY OF THE INVENTION

It is therefore a primary object of the present invention to provide a burglarproof lock for a computer or the likes. A connecting port of the computer or the likes can be connected with or inserted in the burglarproof lock which blocks the connecting port so that an unauthorized person cannot connect other connector with the connecting port to thieve data. The burglarproof lock includes a housing having a connecting section and defining a cavity in which a lock apparatus is mounted. A clutch is disposed in the cavity fr controlling unlocking/locking state of the lock apparatus. The clutch includes a tool mounted on a lock core of the lock apparatus, a valve body controlled by the tool to be movable or unmovable and a complex bolt having an axially movable and rotatable adjustment press button and a bolt member rotatable along with the adjustment press button. The bolt member is connectable and lockable with the connecting port of the computer or the likes or disconnectable and unlockable from the connecting port.

The present invention can be best understood through the following description and accompanying drawings wherein:

DETAILED DESCRIPTION OF THE PREFERRED EMBODIMENTS

Figure 1:
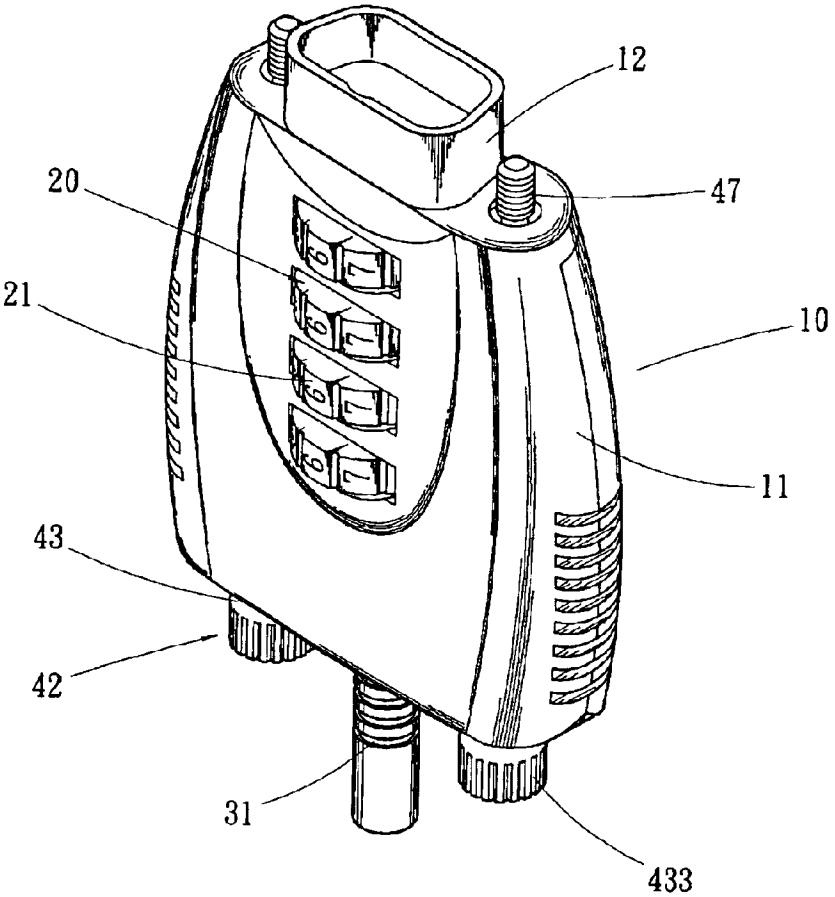
FIG. 1 is a perspective assembled view of the present invention.
Figure 2:
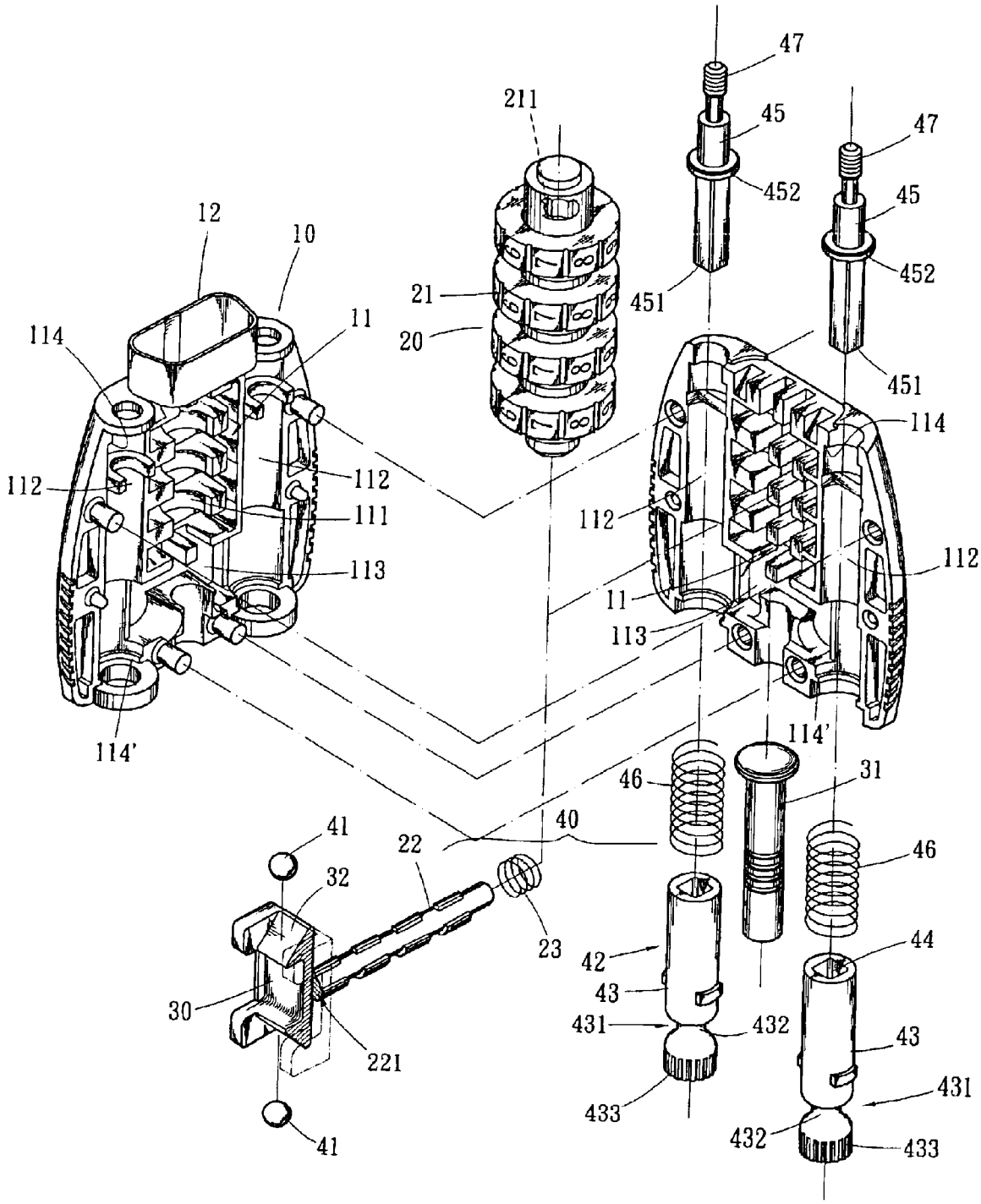
FIG. 2 is a perspective exploded view of the present invention.

Please refer to FIGS. 1 and 2. The burglarproof lock of the present invention includes a housing 10 defining a cavity 11. One end of the housing 10 is formed with a connecting section 12 in which a connecting port of a computer or the like can be inserted. The connecting section 12 has a profile adapted to the connecting port (with trapezoid cross-section, circular cross-section or otherwise shaped cross-section), whereby the connecting section 12 can block the connecting port. (This will be further described hereinafter.) The cavity 11 of the housing 10 can be substantially divided into a first chamber 111 in the middle and two second chambers 112 adjacent to the first chamber 111 on two sides thereof. A numeral lock 20 is mounted in the first chamber 111. The numeral lock 20 is a conventional lock including multiple numeral wheels 21 each having a notch 211 and a lock core 22 fitted in the numeral wheels 21. According to the set numeral positions of the numeral wheels 21, when the notches 211 of the numeral wheels 21 are aligned with each other, the lock core 22 can be axially moved. (This pertains to prior art and will not be further described hereafter.) In a modified embodiment, the numeral lock can be replaced with a key-operable lock.

A head end 221 of the lock core 22 is provided with a tool 30 and a spring 23 normally pushing the tool 30 outward. A steel cord 31 is connected with outer face of the tool 30 and extends out of the housing 10. The lock core 22, spring 23, tool 30 and steel cord 31 are drivingly connected.

Referring to FIG. 2, the present invention further includes two clutches 40 disposed on two sides of the outer face of the tool 30. Each clutch 40 has a valve body 41 which can be a ball. The valve body 41 is confined by the tool 30 within a region 113 of the first chamber 111. In order to smoothen the movement of the valve bodies 41, the tool 30 has two slopes 32 facing the valve bodies 41. When the tool 30 pushes the valve bodies 41, the valve bodies 41 can move along the slopes 32 opposite to each other.

Two complex bolts 42 are mounted in the second chambers 112. Each complex bolt 42 includes an adjustment press button 43 which can be axially moved within the second chamber 112 and rotated. The adjustment press button 43 is a substantially cylindrical body including an adjustment section 433 and a neck section 431 having an annular recess 432. When the adjustment press button 43 is pressed into the cavity 11 of the housing, the valve body 41 is permitted to get into the annular recess 432 to form a locked state. (This will be further described hereafter.) The adjustment press button 43 is formed with a socket 44 in which a bolt member 45 can be moved relative to the adjustment press button 43 with at least the head end 451 of the bolt member 45 constantly detained in the socket 44. In a preferred embodiment, the socket 44 has a polygonal cross-section and at least the head end 451 of the bolt member 45 is a column with polygonal cross-section adapted to the socket 44. Accordingly, when the adjustment press button 43 is rotated, the bolt member 45 will be rotated along with the adjustment press button 43.

Figure 4:
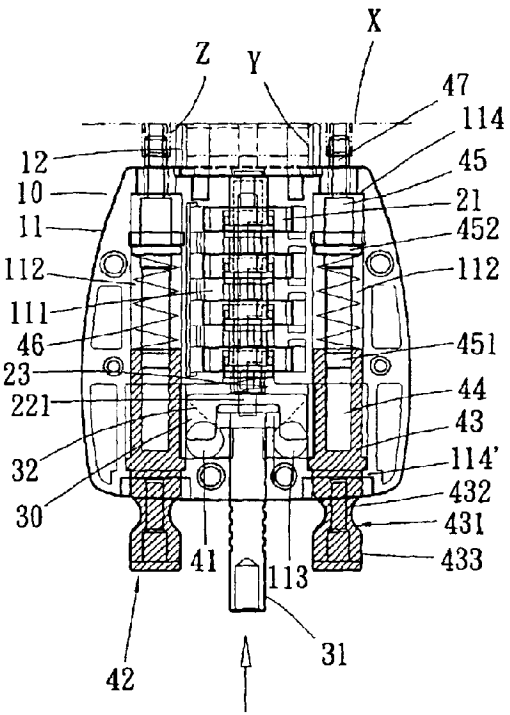
FIG. 4 is a sectional view showing the operation of the present invention, in which the adjustment press buttons of the clutches protrude from the housing and the steel cord can push the tool.

A spring 46 is mounted on the bolt member 45 and confined between an enlarged section 452 of the bolt member 45 and the adjustment press button 43. The spring 46 constantly exerts a force onto the adjustment press button 43 to move out of the housing 10. In a preferred embodiment, the rear end of the bolt member 45 is formed with a threaded section 47 which protrudes from the housing 10. When the adjustment press button 43 is rotated, the threaded section 47 is screwed into or unscrewed out of the thread hole z on each side of the connecting port y of a computer or the likes x (as shown in FIG. 3 or 4).

The second chamber 112 of the cavity 11 is formed with a lower shoulder section 114' and an upper shoulder section 114 for restricting the adjustment press button 43 and the bolt member 45 within the second chamber 112. Accordingly, when axially moved or rotated, the adjustment press button 43 and the bolt member 45 of the clutch 40 are prevented from detaching out of the cavity 11 of the housing.

Figure 5:
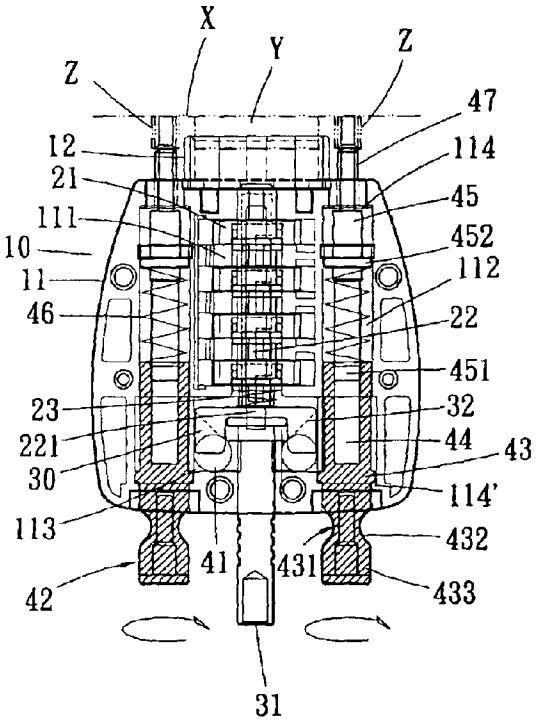
FIG. 5 is a sectional view showing the operation of the present invention and the position of the clutch in the cavity of the housing in an unlocked state, in which the phantom line shows the connecting port of a computer or the likes.
Figure 3:
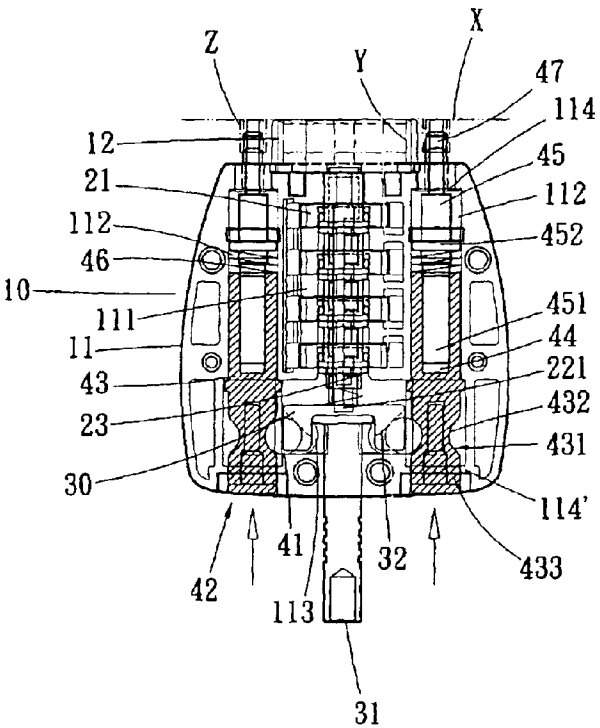
FIG. 3 is a sectional view showing the operation of the present invention and the position of the clutch in the cavity of the housing in a locked state, in which the phantom line shows that the present invention is locked with a computer or the likes to block the connecting port.

FIG. 3 shows that the present invention is in a locked state. In this state, the valve body 41 is confined between the slope 32 of the tool 30 and the annular recess 432 of the adjustment press button 43. At this time, the adjustment press button 43 cannot be moved and the spring 46 is compressed to conserve energy. When every numeral wheels 21 are turned to the set numbers and the notches 211 of the numeral wheels 21 are aligned with each other, the lock core 22 can be freely axially moved. Under such circumstance, a user can push the steel cord 31 to the interior of the housing 10 as shown in FIG. 4. At this time, the tool 30 and the lock core 22 are displaced upward as shown in FIG. 3 or FIG. 4 to compress the spring 23 as shown in FIG. 5. Accordingly, the valve body 41 is released from the pressing force of the tool 30 and becomes movable. At this time, the spring 46 discharges the conserved energy to force the adjustment press button 43 to axially move along the second chamber 112 toward outer side of the housing 10 and protrude from the second chamber 112. At least the adjustment section 433 is exposed to outer side of the housing 10 as shown in FIG. 4.

FIG. 5 shows that a user can align the connecting section 12 of the housing 10 with the connecting port y of a computer or the likes x and insert the connecting port y into the connecting section 12. Then the adjustment section 433 is turned to make the adjustment press button 43 drive and rotate the bolt member 45. At this time, the threaded section 47 of the bolt member 45 is screwed into the thread hole z on each side of the connecting port y. The adjustment section 433 can be pressed into the second chamber 112 of the housing. At this time, the valve body 41 again gets into the annular recess 432 and is confined by the tool 30 as shown in FIG. 3. Accordingly, the burglarproof lock blocks the connecting port y of the computer or the likes x so that an unauthorized person cannot connect other connector with the connecting port y. Only when every numeral wheels 21 are turned to the set numbers, the valve body 41 is released from the restriction of the tool 30 of the clutch 40.

Figure 6:
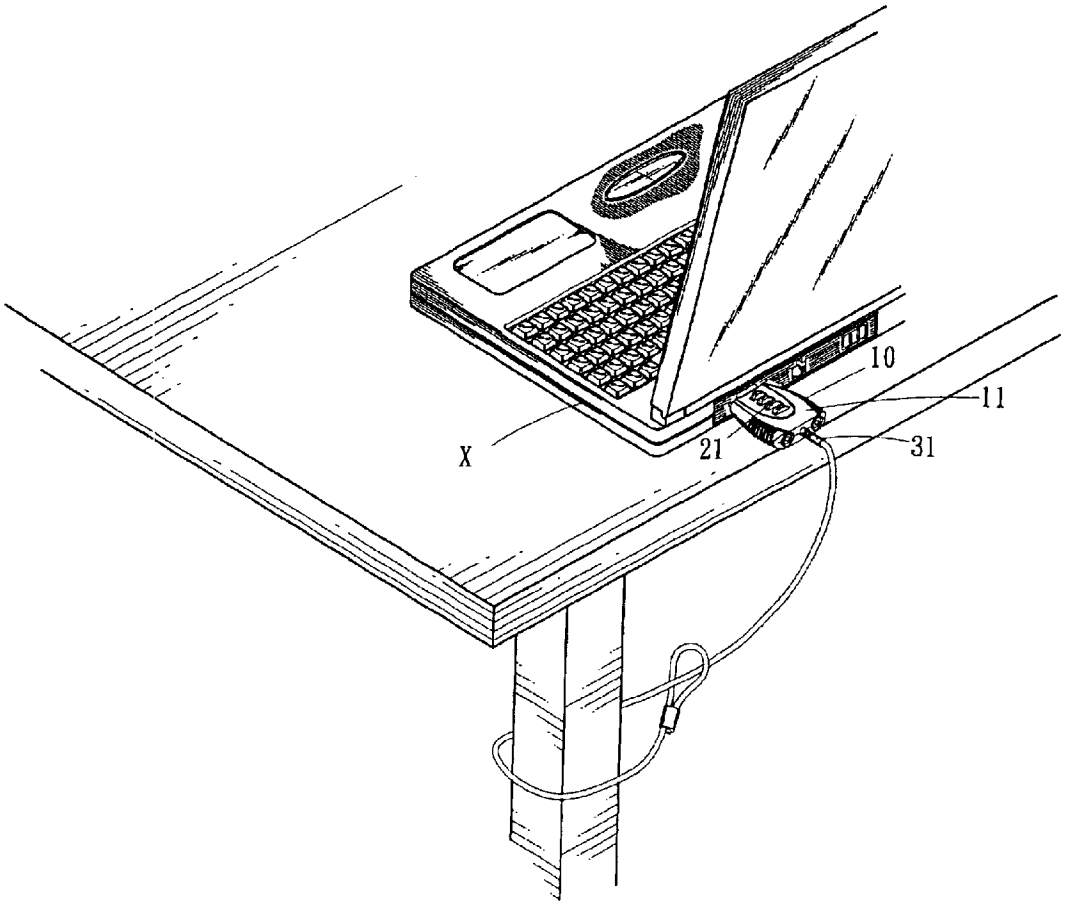
FIG. 6 shows the use of the present invention.

FIG. 6 shows that the other end of the steel cord 31 is fixable on other articles such as a computer desk. The computer or the likes x are locked by the steel cord 31 and the burglarproof lock. Therefore, an authorized person cannot thieve the computer or the likes x.

Figure 7:
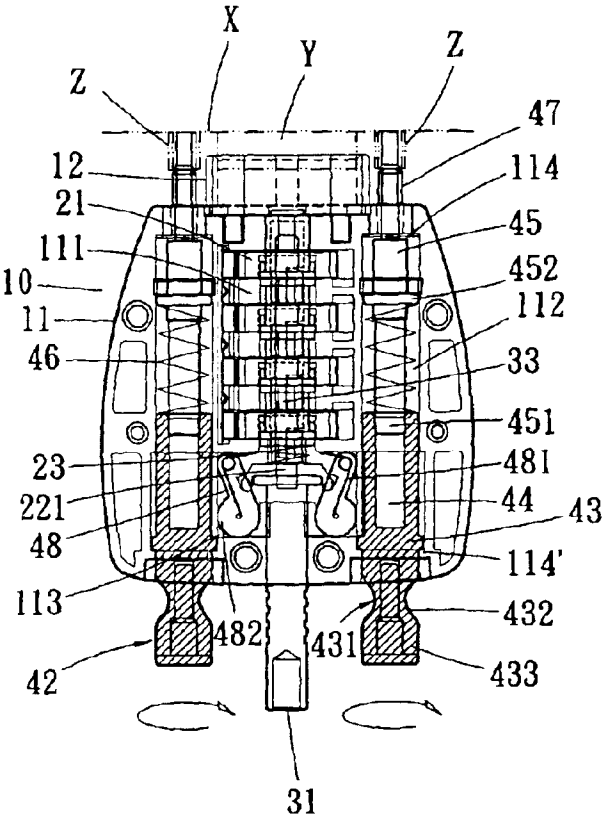
FIG. 7 is a sectional view of another embodiment of the valve body of the clutch of the present invention.
Figure 8:
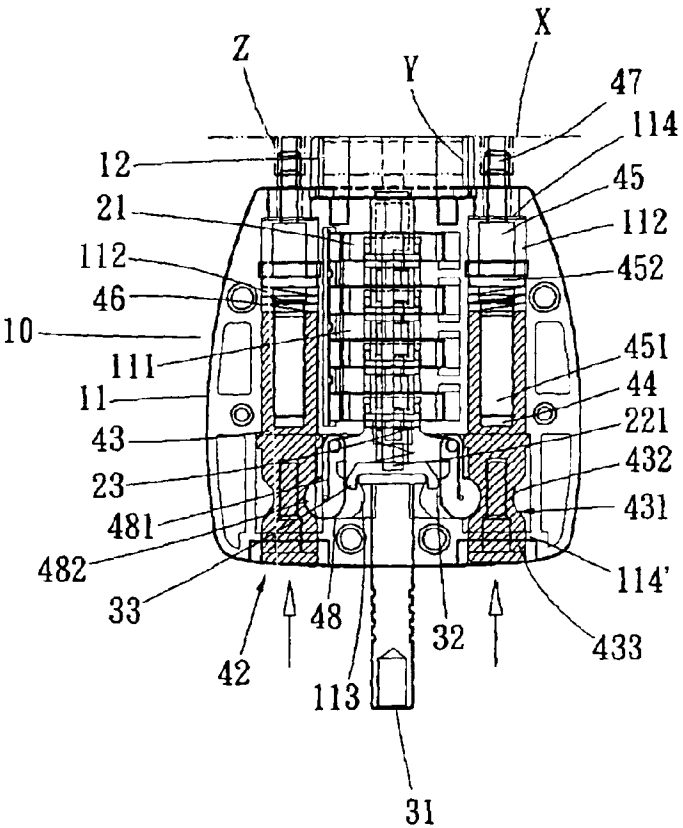
FIG. 8 is a view according to FIG. 7, showing that the valve body is confined between the tool and the annular recess of the adjustment press button.

FIGS. 7 and 8 show another embodiment of the valve body 48 of the clutch 40 of the present invention. The valve body 48 has a spring 481 which constantly biases the valve body 48 toward the complex bolt 42. The valve body 48 further has a projecting section 482. When the adjustment press button 43 is pressed into the cavity 11 of the housing, the spring 481 exerts a force onto the valve body 48 to make the projecting section 482 get into the annular recess 432 of the adjustment press button 43. At this time, the adjustment press button 43 is kept in the cavity 11 without moving. FIG. 8 shows that the valve body 48 is confined between the tool 33 and the annular recess 432 of the adjustment press button 43.

Figure 9:
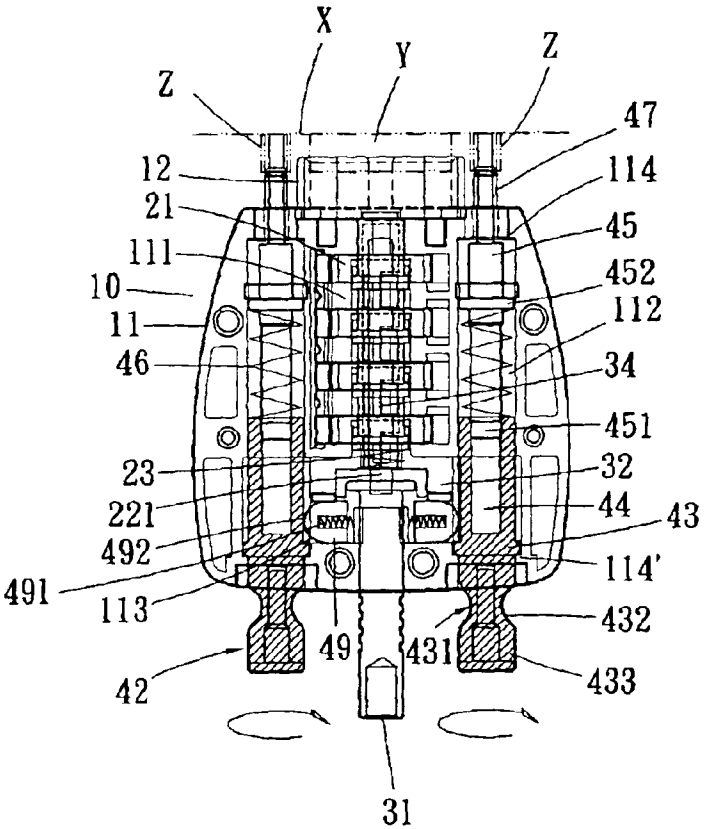
FIG. 9 is a sectional view of still another embodiment of the valve body of the clutch of the present invention.
Figure 10:
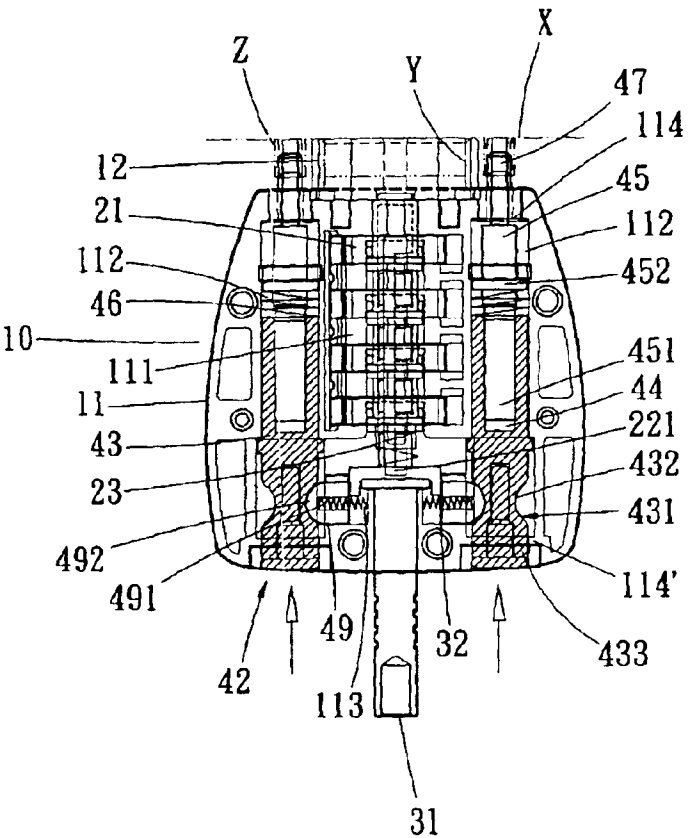
FIG. 10 is a view according to FIG. 9, showing that the valve body is confined between the tool and the annular recess of the adjustment press button.

FIGS. 9 and 10 show still another embodiment of the valve body 49 of the clutch 40 of the present invention. The valve body 49 has a spring 491 which is compressed to exert a force onto the valve body 49, making the valve body 49 move toward the complex bolt 42 on each side. The valve body 48 further has a projecting section 492. When the adjustment press button 43 is pressed into the cavity 11 of the housings the spring 491 exerts a force onto the valve body 49 to make the projecting section 492 get into the annular recess 432 of the adjustment press button 43. At this time, the adjustment press button 43 is kept in the cavity 11 without moving. FIG. 10 shows that the valve body 49 is confined between the tool 34 and the annular recess 432 of the adjustment press button 43. The above embodiments are only used to illustrate the present invention, not intended to limit the scope thereof. Many modifications of the above embodiments can be made without departing from the spirit of the present invention.

What is claimed is:

1. A burglarproof lock for a computer, the burglarproof lock being connectable with or insertable in a connecting port of the computer, the burglarproof lock comprising:

a housing defining a cavity, a lock apparatus being mounted in the cavity, the lock apparatus including an axially reciprocally movable lock core; and a clutch disposed in the cavity for controlling unlocking/locking state of the lock apparatus, the clutch comprising:

a tool mounted on the lock core;

a valve body controlled by the tool to be movable or unmovable; and a complex bolt including an adjustment press button and a bolt member combined with the adjustment press button, a space being defined between the adjustment press button and the bolt member, permitting the adjustment press button to axially move, the complex bolt being rotatable within the cavity about an axis thereof, the adjustment press button being axially pushable into the cavity of the housing to be engaged with the valve body and locked by the lock apparatus, the bolt member being rotatable along with the adjustment press button to be connected and locked with the connecting port of the computer or unlocked and disconnected from the connecting port.

2. The burglarproof lock for the computer as claimed in claim 1, wherein the cavity of the housing includes a first chamber in the middle for mounting the lock apparatus therein and two second chambers adjacent to the first chamber on two sides of the housing, the complex bolt being mounted in each second chamber.

3. The burglarproof lock for the computer as claimed in claim 2, wherein the valve body is confined by the tool within a region of the first chamber.

4. The burglarproof lock for the computer as claimed in claim 2, wherein the second chamber of the cavity is formed with a lower shoulder section and an upper shoulder section for restricting the adjustment press button and the bolt member within the second chamber, whereby the adjustment press button and the bolt member are prevented from detaching out of the housing.

5. The burglarproof lock for the computer as claimed in claim 2, wherein the valve body is a ball member.

6. The burglarproof lock for the computer as claimed in claim 2, wherein a resilient member constantly biases the valve body toward the complex bolt, whereby when the adjustment press button is pressed into the cavity of the housing, the adjustment press button is resiliently engaged with the valve body.

7. The burglarproof lock for the computer as claimed in claim 6, wherein the valve body has a projecting section directed to the complex bolt and the adjustment press button is formed with a recess, whereby when the adjustment press button is pressed into the cavity of the housing, the projecting section is engaged in the recess of the adjustment press button.

8. The burglarproof lock for the computer as claimed in claim 1, wherein the adjustment press button is formed with a socket, the bolt member being axially movably inserted in the socket to connect with the adjustment press button.

9. The burglarproof lock for the computer as claimed in claim 8, wherein the bolt member has a head end and the adjustment press button is formed with a socket at one end, the head end of the bolt member being constantly detained in the socket, the head end having at least one projecting section adapted to a recessed section of the socket.

10. The burglarproof lock for the computer as claimed in claim 9, wherein the head end of the bolt member and the socket of the adjustment press button have corresponding polygonal cross-sections.

11. The burglarproof lock for the computer as claimed in claim 8, wherein the housing has a connecting section in which a connecting port of a computer or the like is connected or inserted.

12. The burglarproof lock for the computer as claimed in claim 8, wherein the second chamber of the cavity is formed with a lower shoulder section and an upper shoulder section for restricting the adjustment press button and the bolt member within the second chamber, whereby the adjustment press button and the bolt member are prevented from detaching out of the housing.

13. The burglarproof lock for the computer as claimed in claim 1, wherein the bolt member has a head end and the adjustment press button is formed with a socket at one end, the head end of the bolt member being constantly detained in the socket, the head end having at least one projecting section adapted to a recessed section of the socket.

14. The burglarproof lock for the computer as claimed in claim 13, wherein the head end of the bolt member and the socket of the adjustment press button have corresponding polygonal cross-sections.

15. The burglarproof lock for the computer as claimed in claim 1, wherein the adjustment press button includes an adjustment section and a neck section having an annular recess, whereby when the adjustment press button is pressed into the cavity of the housing, the valve body is permitted to get into the annular recess.

16. The burglarproof lock for the computer as claimed in claim 3, wherein when the adjustment section of the adjustment press button is pressed into the cavity of the housing, the valve body is confined between the annular recess and the slope of the tool.

17. The burglarproof lock for the computer as claimed in claim 15, wherein a resilient member constantly biases the valve body toward the complex bolt, whereby when the adjustment press button is pressed into the cavity of the housing, the adjustment press button is resiliently engaged with the valve body.

18. The burglarproof lock for the computer as claimed in claim 17, wherein the valve body has a projecting section directed to the complex bolt and the adjustment press button is formed with a recess, whereby when the adjustment press button is pressed into the cavity of the housing, the projecting section is engaged in the recess of the adjustment press button.

19. The burglarproof lock for the computer as claimed in claim 1, wherein the complex bolt further includes a spring mounted between the adjustment press button and the bolt member, whereby the spring constantly exerts a force onto the adjustment press button to move out of the housing.

20. The burglarproof lock for the computer as claimed in claim 1, wherein a steel cord is connected with outer face of the tool and extends out of the housing, the tool having two slopes facing the valve bodies, whereby when the tool pushes the valve bodies, the valve bodies are moved along the slopes opposite to each other.

21. The burglarproof lock for the computer as claimed in claim 20, wherein the housing has a connecting section in which a connecting port of a computer or the like is connected or inserted.

22. The burglarproof lock for the computer as claimed in claim 20, wherein in an unlocked state, the steel cord can push the tool to make the valve body movable.

23. The burglarproof lock for the computer as claimed in claim 20, wherein when the adjustment section of the adjustment press button is pressed into the cavity of the housing, the valve body is confined between the annular recess and the slope of the tool.

24. The burglarproof lock for the computer as claimed in claim 1, wherein a spring is disposed between a head end of the lock core and the tool, the spring normally exerting an outward pushing force on the tool.

25. The burglarproof lock for the computer as claimed in claim 1, wherein the valve body is confined by the tool within a region of the first chamber.

26. The burglarproof lock for the computer as claimed in claim 1, wherein the housing has a connecting section in which a connecting port of a computer or the like is connected or inserted.

27. The burglarproof lock for the computer as claimed in claim 26, wherein the bolt member has a threaded section protruding from the housing for screwing into a thread hole on each side of the connecting port.

28. The burglarproof lock for the computer as claimed in claim 26, wherein the connecting section of the housing has a trapezoid cross-section.

29. The burglarproof lock for the computer as claimed in claim 1, wherein the lock apparatus is a numeral lock having multiple numeral wheels.

30. The burglarproof lock for the computer as claimed in claim 1, wherein the second chamber of the cavity is formed with a lower shoulder section and an upper shoulder section for restricting the adjustment press button and the bolt member within the second chamber, whereby the adjustment press button and the bolt member are prevented from detaching out of the housing.

31. The burglarproof lock for the computer as claimed in claim 1, wherein in an unlocked state, the steel cord can push the tool to make the valve body movable.

32. The burglarproof lock for the computer as claimed in claim 1, wherein the valve body is a ball member.

33. The burglarproof lock for the computer as claimed in claim 1, wherein a resilient member constantly biases the valve body toward the complex bolt, whereby when the adjustment press button is pressed into the cavity of the housing, the adjustment press button is resiliently engaged with the valve body.

34. The burglarproof lock for the computer as claimed in claim 33, wherein the valve body has a projecting section directed to the complex bolt and the adjustment press button is formed with a recess, whereby when the adjustment press button is pressed into the cavity of the housing, the projecting section is engaged in the recess of the adjustment press button.

* * * * *